United States Patent [19]

Coxhill

[11] 4,034,922

[45] July 12, 1977

[54] GYRATORY CRUSHER WITH BUSHING ASSEMBLY BETWEEN INNER ECCENTRIC ANTIFRICTION BEARING

[75] Inventor: Major Coxhill, Appleton, Wis.

[73] Assignee: Allis-Chalmers Corporation, Milwaukee, Wis.

[21] Appl. No.: 693,783

[22] Filed: June 8, 1976

[51] Int. Cl.[2] ..... B02C 2/04

[52] U.S. Cl. ..... 241/213; 241/215

[58] Field of Search ..... 841/207–216

[56] References Cited

U.S. PATENT DOCUMENTS

| | | | |
|---|---|---|---|
| 2,833,486 | 5/1958 | MacLeod | 241/215 |
| 3,372,881 | 3/1968 | Winter | 241/208 |
| 3,384,312 | 5/1968 | Patterson et al. | 241/208 |
| 3,532,277 | 10/1970 | Decker et al. | 241/208 |
| 3,539,119 | 11/1970 | Cook | 241/215 |

*Primary Examiner*—Roy Lake
*Assistant Examiner*—Howard N. Goldberg
*Attorney, Agent, or Firm*—Robert C. Jones

[57] ABSTRACT

In a crusher having a crusher head shaft which is adjustable under load in the vertical direction and passes through a drive eccentric, clearance must exist between the shaft and the inner eccentric bearing. Due to the constantly rotating crushing load which moves angularly in the same direction as the drive eccentric is rotating and relative to the shaft which is stationary or slowly rotating in a direction opposite to the direction in which the drive eccentric is rotating, the inner race of the inner bearing of the eccentric should be an interference fit on the shaft. If the inner race is not an interference fit on the shaft, rapid wear will occur on both the shaft and the bearing bore. To overcome these two opposing requirements of a loose fit for adjusting purposes and a tight fit for good bearing practice, a composite bushing assembly is provided. The assembly includes a steel bushing and a bronze bushing with the steel bushing having an interference fit in the bearing race while the bronze bushing provides the necessary clearance for the vertical adjustment of the shaft.

3 Claims, 1 Drawing Figure

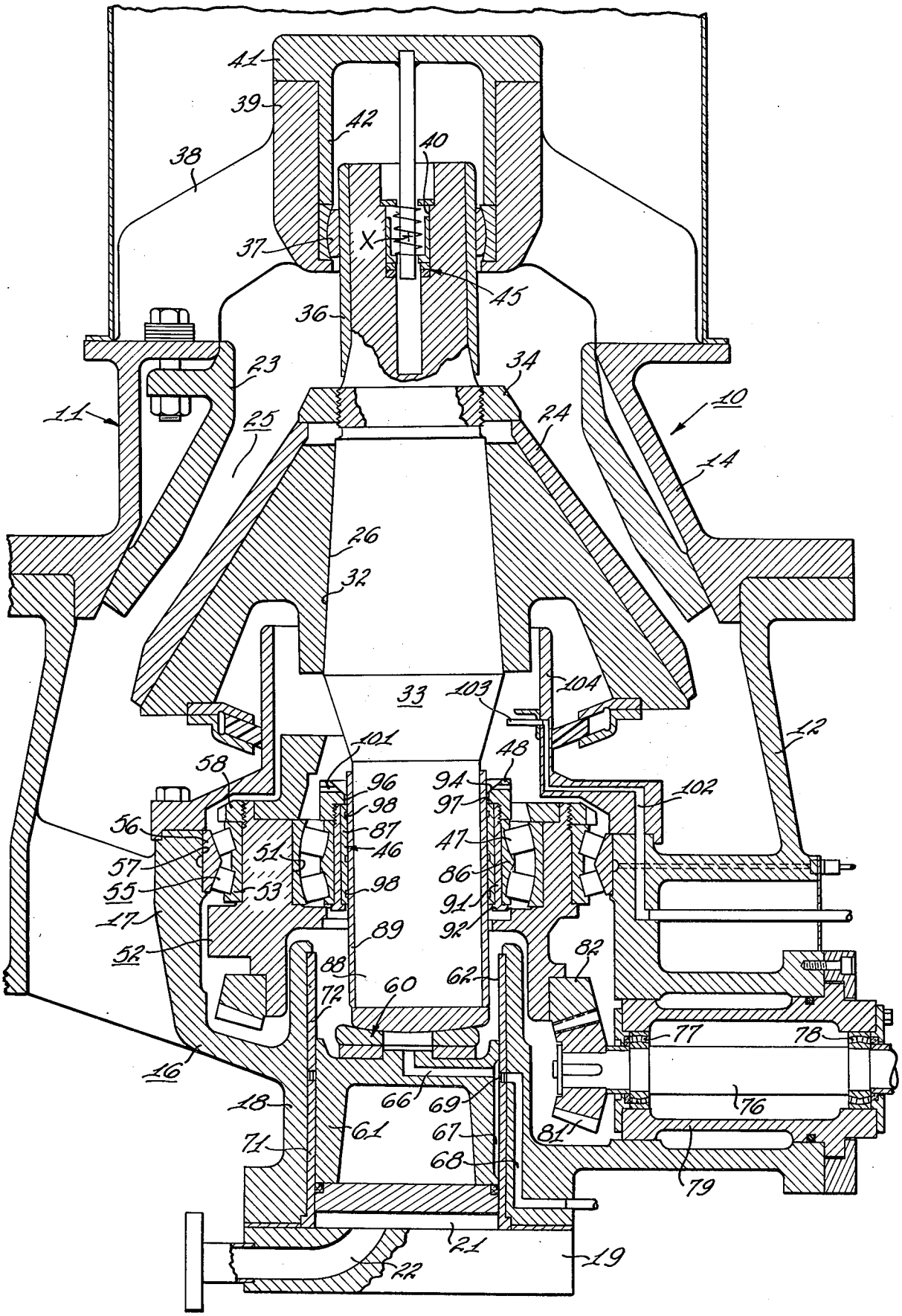
41
39
42
40
38
37
X
45
36
23
34
11
25
24
10
14
26
32
33
103
104
12
101
48
58
96
94
102
98
97
56
87
47
57
51
46
86
55
53
98
91
17
92
52
89
82
88
62
60
72
77
78
16
66
69
76
18
61
67
81
71
68
79
21
19
22

GYRATORY CRUSHER WITH BUSHING ASSEMBLY BETWEEN INNER ECCENTRIC ANTIFRICTION BEARING

BACKGROUND OF THE INVENTION

In a gyratory crusher where the crusher head shaft passes through a drive eccentric and is adjustable under load in a vertical direction, clearance must exist between the shaft and the inner race of the inner bearing of the eccentric. Also, due to the fact that the crushing load will rotate or more angularly relative to the shaft in the direction that the drive eccentric rotates, the bearing inner race should be an interference fit on the shaft. If the inner race is not an interference fit, rapid wear will occur on both the shaft and the bearing bore.

SUMMARY OF THE INVENTION

Overcoming the aforementioned requirements of a loose fit for adjustment purposes and a tight fit for good bearing practice, a composite bushing assembly is provided. A steel bushing or sleeve in which a bronze bushing or sleeve is interfitted, the arrangement is such that the steel bushing has an interference fit with the inner race of the inner eccentric bearing. The bronze bushing receives the shaft and the fit therebetween is such as to provide sufficient clearance to allow for adjustment of the shaft under load in a vertical direction.

While crushing, the crusher head shaft in a gyratory crusher will rotate in the opposite direction to that of the shaft drive eccentric. The speed of this reverse rotation will depend upon the crusher head diameter and the throw of the drive eccentric. The clearance between the shaft and the inner bushing or sleeve of the bearing assembly does not have the same clearance/-diameter ratio as the throw and crusher head diameter. As a result, the shaft will skid in the inner bushing of the composite bushing assembly. Thus, the inner bushing or sleeve must be of a material which is suitable to provide a bearing for rotational as well as vertical sliding between the shaft and the inner bushing under mixed lubrication conditions. The outer bushing of the assembly is steel to provide the rigidity necessary for support.

DESCRIPTION OF THE DRAWING

The drawing shows a view in vertical section through a gyratory type crusher in which the crusher head shaft is adjusted in a vertical direction and in which the present invention is incorporated.

DESCRIPTION OF THE INVENTION

Referring to the drawing, there is shown a gyratory crusher 10 having a frame generally indicated at 11 and including a lower frame section 12 and an upper frame section 14. The lower frame section 12 includes a fixed vertical hub 16 having an upper portion 17 and a lower portion 18. The lower hub portion 18 is provided with a closure plate 19 which forms a sealed chamber 21. The closure plate 19 also provides for a hydraulic fluid inlet 22 which communicates with the expansible chamber 21.

The upper frame section 14 opens upwardly and has secured therein a concave ring 23 which is supported in coaxial relationship above the hub 16. A generally conical crushing head 24 projects upwardly within the concave ring 23 to define therebetween a crushing chamber 25. The crushing head 24 is supported and arranged with its central axis inclined relative to and intersecting with the vertical axis of the hub 16 and concave ring 23. The axes intersect at a point X in a horizontal plane which passes through the midpoint of a bearing 37. The crushing head 24 has a central upwardly tapering bore 26 which is adapted to receive a tapered or frusto-conical portion 32 of a crusher shaft 33.

A nut 34 is threadedly engaged on the crusher shaft 33 at a position adjacent the upper end of the crusher head 24 and serves to lock the crusher head in operative position on the shaft 33. The upper portion of the crusher shaft 33 is fitted with a bearing sleeve 36 received in an adjustable bearing member 37. A spider 38 bolted to the top of the frame 11 presents an axial hub 39, the axis of which is concentric with the axis of the frame. The hub 39 serves as a housing for an adjustable bearing 37. A cap 41 having an axially extending sleeve portion 42 is secured to the outer end race of the hub 39 and locks the outer race of the adjustable bearing 37 in the hub. A crusher head brake device 45 is accommodated in a suitable stepped bore 40 formed in the upper end of the crusher head shaft 33.

The lower end of the crusher head shaft 33 is provided with a bearing sleeve assembly 46 which is journalled in the inner race of a radial bearing 47. A nut 48 threadedly engaged on the outer member of the bearing assembly 46 is formed with an axially extending sleeve portion which abuts the inner race of the radial bearing 47 to lock it in position. The outer race of radial bearing 47 is supported in a bore 51 of a drive eccentric 52. A bearing surface formed on the exterior of the drive eccentric 52 receives the inner race 53 of a radial bearing 55. The outer race 56 of the bearing 55 is disposed in a circular seat 57 formed on the upper portion 17 of the vertical hub 16. To maintain the bearing 55 stationary within the circular seat 57, the outer race 56 of the bearing has an interference fit with the circular wall of the bearing seat 57. A nut 58 is threadedly engaged on a circular extension of the drive eccentric 52 and is disposed to abut the inner race 53 of the bearing 55.

An axial thrust bearing 60 is disposed beneath the crusher head shaft 33 between the lower axial end race thereof and a piston 61 within a cylinder 62 defined by the closure plate 19. Lubrication of the thrust bearing 60 is accomplished through a communicating oil passage 66 formed in the head of the piston 61. The passage 66 communicates with a vertical oil groove 67 in the exterior surface of the piston. Lubricating oil from a source (not shown) is supplied to the vertical groove 67 via a passage 68 that connects with the vertical groove 67 via a circumferential groove or space 69 between liners 71, and 72 of the cylinder 62.

To drive the crusher, a pinion gear drive shaft 76 is journalled in bearings 77 and 78 carried by a bearing carrier 79 which is disposed within a laterally extending hub formed with the lower portion 18 of the frame hub section 16. The shaft 76 is driven by any suitable source of power. At its inner end, drive shaft 76 carries a pinion drive gear 81 that is in meshing engagement with a gear 82 connected to the drive eccentric 52. Thus, shaft 33 is free to move axially up and down within the bearing sleeve assembly 46 while still maintaining its gyratory drive connection with the drive eccentric 52.

In the operation of the crusher 10, power is applied to drive the pinion 81 and rotate the gear 82. This effects rotation of the drive eccentric 52 which rotates in an orbit about the vertical axis of the crusher. Thus, the axis of the crusher head shaft 33 is driven in a gyratory motion and transcribes a cone about the central vertical axis of the crusher. This motion provides the crushing action of head 24 in the crushing chamber 25. As the crusher head shaft 33 is driven in its gyratory motion about the central vertical axis of the crusher, crushing forces which are the result of stone being broken between the head 24 and the concave 23 develop forces which react on the head 24. These forces cause the head 24 and thereby the shaft 33 to rotate about the axis of the crusher head shaft 33 slowly in the opposite direction to the eccentric 52 while the crusher head shaft is being bodily moved in a gyratory path of travel about the central vertical axis of the crusher.

Vertical support and positioning of the crusher head 24 for adjusting the opening of the crushing chamber 25 is accomplished by hydraulic fluid under pressure. For this purpose, hydraulic fluid under pressure is supplied to the expansible chamber 21 via the passage 22 in the closure plate 19. The fluid under pressure in chamber 21 reacts on the piston 61 elevating the shaft 33 and thereby the crusher head 24 (or lowers the assembly) as desired.

As previously mentioned, in a gyratory crusher having a crusher head shaft 33 that is adjustable under load in the vertical direction and which passes through the drive eccentric 52, clearance must exist between the shaft 33 and the inner race 86 of the inner antifriction bearing 47 associated with the drive eccentric 52. Also, due to the condition that the crushing load rotates with the eccentric 52 and in the opposite direction to the slowly rotating shaft 33 when the crusher is under load, the inner race 86 should have an interference fit on the shaft 33.

To satisfy these two requirements, the bearing assembly 46 is provided. As shown, the bearing assembly includes a bronze bearing sleeve 87 which is mounted on the reduced lower end 88 of the shaft 33. In the present instance, the reduced lower end 88 of the shaft 33 is provided with a steel sleeve 89 on which the bronze bearing sleeve 87 is mounted. Interposed between the bronze bearing sleeve 87 and the inner race 86 of the antifriction bearing 47 is a steel bearing sleeve 91. The bronze bearing sleeve 87 is concentric within the steel bearing sleeve and has a no clearance fit therewith. The steel bearing sleeve 91 has an interference fit with the inner race 86 to provide the desired stiffness to resist the radial loads which are developed due to the gyratory movement of the drive eccentric and the crushing load. Also, the interference fit prevents relative circumferential movement between the sleeve 91 and the bearing inner race 86. As shown, the steel bearing sleeve at its lower end is provided with a flange 92. The radially inwardly extending portion of the flange 92 abuts the lower axial end race of the bronze bearing sleeve 87 to maintain it in an operative position. The radially outwardly extending portion of the flange 92 abuts the lower axial end race of the inner race 86 of bearing 47.

The nut 48, as previously mentioned, is threadedly engaged on the threaded upper end of the steel bearing sleeve 91 and locks the entire bearing assembly 46 in operative position.

To provide lubrication to the antifriction bearing 47 and also to inner surface of the bronze bearing sleeve 87, the nut 48 is formed with inwardly and downwardly sloping circular surface 94. The circular surface 94 in cooperation with the upper end of the steel sleeve 89 serves as an oil reservoir. As can be seen, the diameter of the inner surface 96 of the nut 48 is greater than the outer diameter of the sleeve 89. Thus, a circular space 97 is provided which serves to direct lubricating oil between the bronze bearing sleeve 87 and the rotating steel sleeve 89. The inner surface of the bronze bearing sleeve 87 is provided with a plurality of circumferential oil grooves 98 which capture the oil that passes between the bronze bearing sleeve 87 and the steel sleeve 89. The oil captured in the grooves 98 insure that oil to lubricate the sliding surfaces is available.

To effect positive lubrication of the antifriction elements of the bearing 47, a plurality of horizontal radially extending ports 101 are formed as by drillng in the nut 48. Thus, lubricating oil collected in the nut reservoir will flow out through the ports 101 and flow down the sides of the nut falling onto the antifriction elements of the bearing 47. Lubricating oil is supplied to the interior of the crusher above the bearing 47 by oil passage 102 and oil pipe 103 which extends inwardly toward the shaft 33 from a dust collar 104.

The embodiments of the invention in which an exclusive property or privilege is claimed are defined as follows:

1. In a gyratory crusher having a frame, a crusher head carried by a shaft which is supported by the frame for rotation about its own axis, for gyratory movement about the axis of the frame and for adjustment under load in a vertical direction, a drive eccentric through which the shaft extends and operable to effect the gyratory movement of the shaft and crusher head, and having an inner antifriction bearing which is carried by the drive eccentric for rotatably supporting the shaft in the drive eccentric;

a bearing assembly interposed between the inner antifriction bearing and the shaft, said bearing assembly including two separate cylindrical sleeve members interengaged with each other, substantially over their entire length, and in concentric relationship, said inner cylindrical sleeve member being of relatively soft material and said outer cylindrical sleeve member being of a relatively harder material, said outer cylindrical sleeve member having an interference fit with the inner bearing race of the inner antifriction bearing to prevent relative movement between the bearing assembly and the inner antifriction bearing inner bearing race due to a rotating load, said inner cylindrical sleeve member having a clearance fit with the shaft to permit adjustment of the shaft under load in a vertical direction; and, means to supply lubrication to the antifriction elements of the inner antifriction bearing and to the sliding surfaces present by said inner cylindrical sleeve member and the shaft;

whereby the shaft is rigidly supported in a radial direction by operation of the outer cylindrical sleeve member and said outer cylindrical sleeve member has an interference fit with the inner race of the inner antifriction bearing, and said inner cylindrical sleeve member of said bearing assembly provides for a clearance fit between itself and the shaft to provide for shaft movement under load in a vertical direction.

2. A gyratory crusher according to claim 1 wherein said outer cylindrical sleeve member is steel and has an interface fit with the inner bearing race of said inner antifriction bearing;

said inner cylindrical sleeve member is bronze and constructed and arranged in concentric relationship within said outer cylindrical steel sleeve member with a no-clearance fit relationship;

a nut threadedly engaged on the upper end of said outer cylindrical steel sleeve member and constructed and arranged to abut the upper axial end face of said inner cylindrical bronze sleeve member and the upper axial end face of the inner race of the inner antifriction bearing to effectively secure said sleeve members in operative position.

3. A gyratory crusher according to claim 2 wherein said nut is formed with a radially inwardly sloping conical surface which operates to provide a reservoir for lubricating oil;

said nut below said reservoir having a circular wall surface which is concentric with respect to the shaft and in communication with said reservoir, the diameter of said circular wall surface being larger than the diameter of the portion of the shaft around which it is engaged to form a lubricating flow passage therebetween to direct lugricant to the joint surface between said bronze bearing sleeve and the shaft; and, a plurality of ports formed in the upper portion of said nut, said ports extending radially inwardly from the outer surface of said nut into communication with said reservoir, said ports operating to provide oil flow channels to the exterior of the nut so that the oil will flow down the exterior of the nut and onto the antifriction elements of the inner antifriction bearing.

* * * * *